United States Patent [19]

Rowland

[11] 4,318,556

[45] Mar. 9, 1982

[54] CHAIR AND SEAT-BACK UNIT THEREFOR

[76] Inventor: David L. Rowland, 8 E. 62nd St., New York, N.Y. 10021

[21] Appl. No.: 47,483

[22] Filed: Jun. 11, 1979

[51] Int. Cl.[3] ..... A47C 3/00; A47C 7/16

[52] U.S. Cl. ..... 297/445; D6/70; 297/440; 297/452; 297/454; 297/458

[58] Field of Search ..... 297/440, 441, 460, 445, 297/452, 454, 455, 458, 459; D6/70; 248/188, 188.7, 188.8, 188.1

[56] References Cited

U.S. PATENT DOCUMENTS

| | | | |
|---|---|---|---|
| 2,731,076 | 1/1956 | Rowland | 297/457 |
| 2,758,632 | 8/1956 | Koller et al. | 248/188.1 |
| 2,851,236 | 9/1958 | Koller et al. | 248/188.1 X |
| 2,903,044 | 9/1959 | Peras | 297/445 X |
| 3,093,356 | 6/1963 | Buyalos, Jr. | 248/188.1 |
| 3,224,719 | 12/1965 | Beckman et al. | 248/188.7 X |
| 3,774,967 | 11/1973 | Rowland | 297/445 |
| 4,045,090 | 8/1977 | Fleisch et al. | 297/440 |
| 4,148,106 | 4/1979 | Gallien | 297/440 |
| 4,265,483 | 5/1981 | Raferty et al. | 297/445 |

FOREIGN PATENT DOCUMENTS

| | | | |
|---|---|---|---|
| 2619037 | 1/1977 | Fed. Rep. of Germany | 297/440 |
| 72850 | 10/1945 | Norway | 297/440 |
| WO79/00074 | 2/1979 | PCT Int'l Appl. | 297/440 |
| 21123 | of 1910 | United Kingdom | 297/454 |
| 744618 | 2/1956 | United Kingdom | 297/227 |
| 1206587 | 9/1970 | United Kingdom | 297/440 |

OTHER PUBLICATIONS

*Brown Jordan's Circa,* Copyright 1976, p. 1.

*Primary Examiner*—James T. McCall
*Attorney, Agent, or Firm*—Owen, Wickersham & Erickson

[57] ABSTRACT

A seat-back unit for a chair utilizes pre-flexed sheets of sinuous spring wire material connected to relatively rigid side support members which afford flexibility, but provide a frame for the unit. The two L-shaped side support members are held apart by a rigid cross stretcher member positioned in the seat portion, near the back. The seat-back unit is connected to a chair frame at only four points in a "cradling" arrangement, by means of a pair of hooks extending back from the tops of the relatively rigid members, received in slots of the chair frame, and by bolted connections of the relatively rigid members at the front of the seat portion to the chair frame. The seat-back unit, and particularly the relatively rigid frame members, are put into a pre-stressed condition as the seat portion is connected to the chair frame. Covering material, which may be removable, is positioned over the seat-back unit. A simple chair frame structure is preferably used, with an X-shaped bracing configuration at the bottom and four upright legs. This may be accomplished with two tubular members, each formed into a front and a rear leg, and an angled portion of a brace, with the portions connected together centrally.

15 Claims, 17 Drawing Figures

FIG. 4
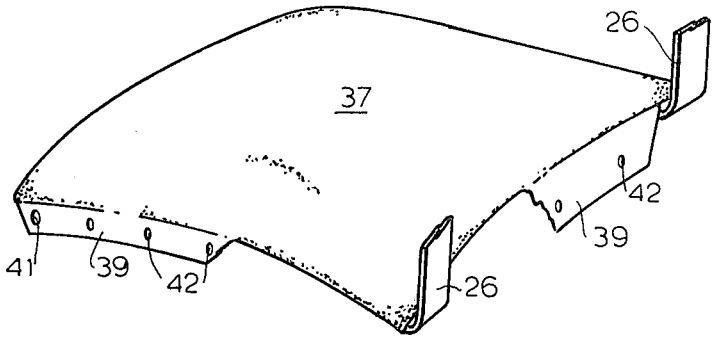
FIG. 5
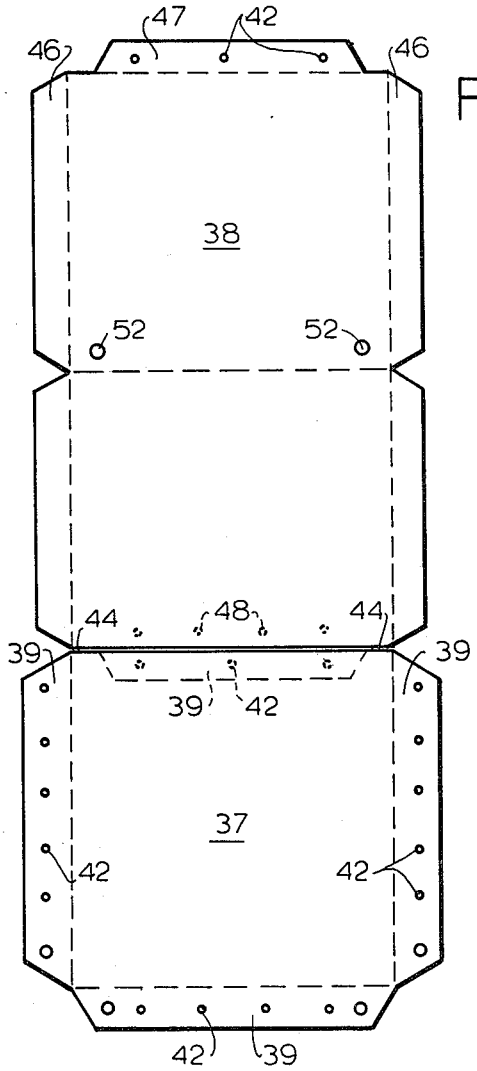
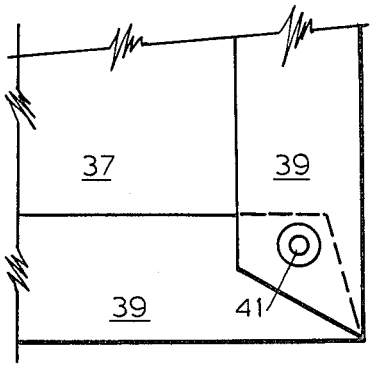
FIG. 6

FIG. 7
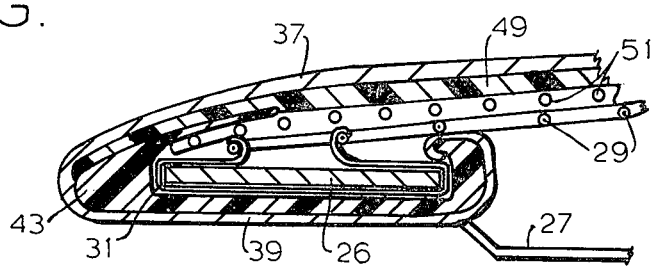
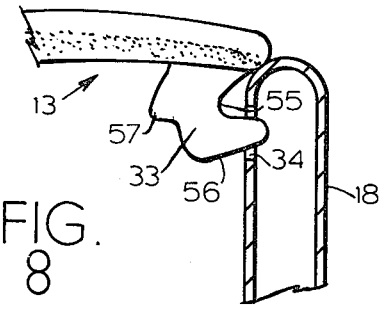
FIG. 8
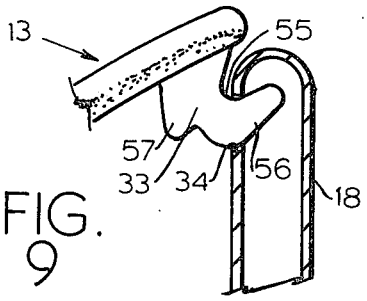
FIG. 9
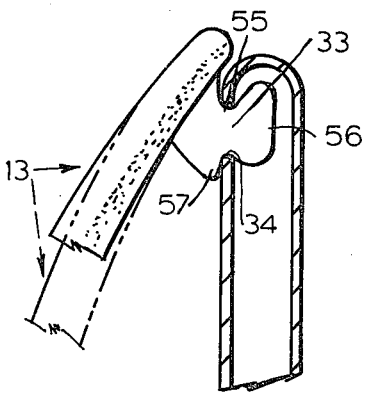
FIG. 10

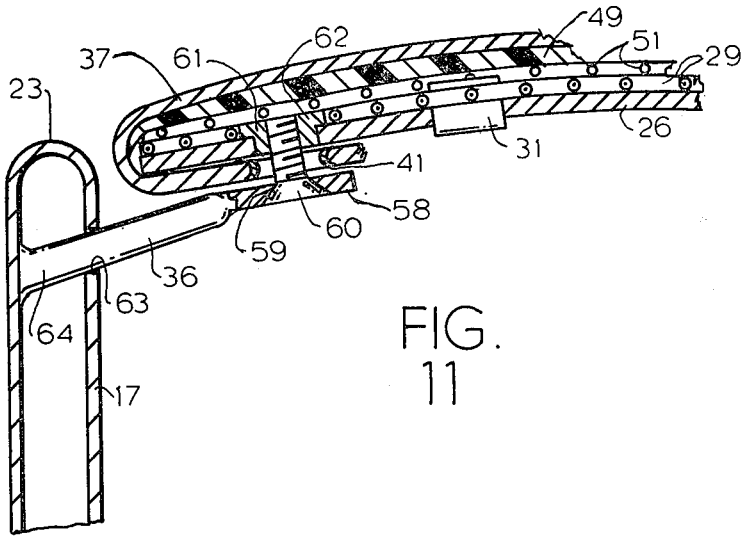
FIG. 11
FIG. 12
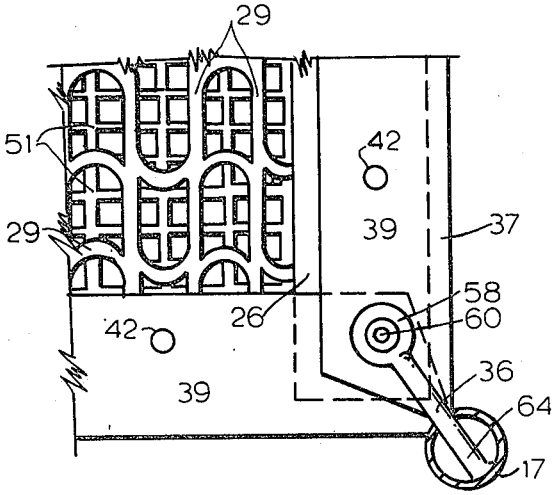

CHAIR AND SEAT-BACK UNIT THEREFOR

BACKGROUND OF THE INVENTION

Heretofore chairs usually had frames for seat and legs that were rigid both in structure and attachment of component parts. This meant that chairs had to have thick cushioning in the seat and back areas if resilient comfort was desired, or a sacrifice of comfort was made through the use of a seat and back of hard materials such as sheet metal, plywood or rigid plastic.

Another shortcoming of previous chair and seat designs was that they incorporated backs incapable of fitting a range of sitters's sizes and forms. If the back was comfortable for a large person, it was not for a small person, and vice versa. Many attempts were made to provide back height and angle adjustment but these required the sitter to know how to operate the adjusting mechanisms as well as to know what the most ideal configuration of the chair should be for a person of his size and form, something only an expert orthopedist would know.

Previously, upholstery on chairs was usually tacked or stapled on permanently, and removal for cleaning was very inconvenient and often impossible for a non-expert. Such chairs were seldom properly cleaned. Reupsholstering also required experts and often cost nearly as much as the initial total price of the chair. Sometimes stretch fabrics were used but those were susceptible to easy pricking by sharp objects and would unravel, sometimes similarly to ladies' hose, and would not wear as long as conventional non-stretch fabrics.

Heretofore, few chair frames were readily separable from leg structures, and those that were required unsightly screws to attach the seat and back elements to the frame. Also, previous chair frame structures have usually been rigid in a manner which caused the chair to wobble or tip on uneven floor surfaces.

No seat-back or chair design has provided workable solutions to these problems, until the present invention described below.

SUMMARY OF THE INVENTION

The present invention provides a totally new construction for a seat-back unit and for a chair incorporating the unit. The seat and back are non-rigid, both flexing with the user's weight to provide maximum comfort. Cushioning as used on rigid-backed seats and backs is not required with the present construction, but a relatively thin layer of padding is preferably incorporated, for a better feel, flexing along with the entire seat or back. A variety of sitter sizes, weights and shapes can be accommodated, with no adjustment required or provided in the chair. In particular, the small of the back is adequately and correctly supported, for a wide range of user sizes and weights, by virtue of the seat-back structure and the "cradling" arrangement in which it is supported on the chair frame.

The seat-back unit is constructed of a pair of spaced generally L-shaped side frame members of a relatively rigid but flexible material such as spring steel, with a rigid cross member holding the two side frame members spaced apart. Flexible sheets of sinuous spring wire material are stretched between the side frame members, in prestressed fashion, for supporting the sitter. Such sinuous spring wire material is preferably as described in U.S. Pat. Nos. 3,720,568 and 3,843,477.

The seat portion and back porton of the seat-back unit preferably include an "insulator" layer over the wire material and the side frame members, which may be a mesh material to prevent the wire material from being felt by the sitter. Above the insulator layer is a relatively thin layer of padding, with an outer covering over the padding. For simple and inexpensive cleaning and replacement, the fabric coverings are removable from the unit, a feature made possible by the overall construction of the unit and of the chair itself.

The seat-back unit is connected to a simple chair frame at only four points—two at the top corners of the back, and two at the front corners of the seat, in a "cradling" support arrangement. This provides for optimum support, comfort and versatility in accommodating different-sized users comfortably, while also affording easy dismantiing of the seat-back unit from the chair frame. A hook-and-slot arrangement connects the top of the back to the frame; with this connection made, the seat must be forced down until its front is in the proper position, where it is bolted to the frame. All four connections are therefore tight, without the possibility of relative movement or vibration. For dismantling of the seat-back unit from the chair frame, two bolts at the underside of the seat front corners are removed, and the unit is then free to be disconnected from the frame. The removal of the unit is necessary for removal of the fabric covers, and also permits other maintenance or replacement of either the seat-back unit or the chair frame, should this become necessary.

The chair frame is simple but efficient, being constructed of two preferably tubular components joined only at the bottom, in a bracing arrangement. Its construction allows the chair to sit on an unven surface stably, without wobble.

Accordingly, in one embodiment a seat-back unit of the invention, adapted to be supported on a chair frame, comprises a pair of relatively rigid but springingly flexible side frame members of generally L-shape, with spacing means holding them in spaced apart and generally parallel relationship, forming a seat portion and a back portion; sinuous spring wire material extending between the side frame members of the seat and back portions; outer covering means over the seat and back portions; and means for connection of the seat-back unit, from the ends of the side frame members, to a chair frame.

A chair according to the invention comprises the seat-back unit connected by the four points at the ends of its side frame members to a chair frame.

It is therefore among the objects of the invention to provide a highly versatile chair construction, comfortable to a wide range of user sizes and weights, easily kept clean through use of removable coverings and readily dismantled if required, while still being relatively simple, light in weight and economically produced. These and other objects, advantages and features of the invention will be apparent from the following description of a preferred embodiment, taken in conjunction with the accompanying drawings.

DESCRIPTION OF THE DRAWINGS

FIG. 4 is a fragmented perspective view showing the seat portion of the seat-back unit and illustrating the assembly of the cover material.

FIG. 5 is a view showing the cover for the seat-back unit in a flattened position, before folding, stitching and assembly.

FIG. 6 is a fractional bottom plan view showing a corner of the seat portion with assembled cover.

FIG. 7 is a frontal sectional view taken along the line 7—7 of FIG. 3, showing construction details of the assembled seat-back unit.

FIGS. 8, 9 and 10 are similar side views, partially sectioned, illustrating the assembly of the seat-back unit to the chair frame.

FIG. 11 is a side sectional view illustrating the connection of the seat-back unit to the front of the chair frame.

FIG. 12 is a fractional bottom plan view of a front corner of the chair, showing the connection of the seat-back unit to the chair frame.

DESCRIPTION OF THE PREFERRED EMBODIMENTS

Figure 1:
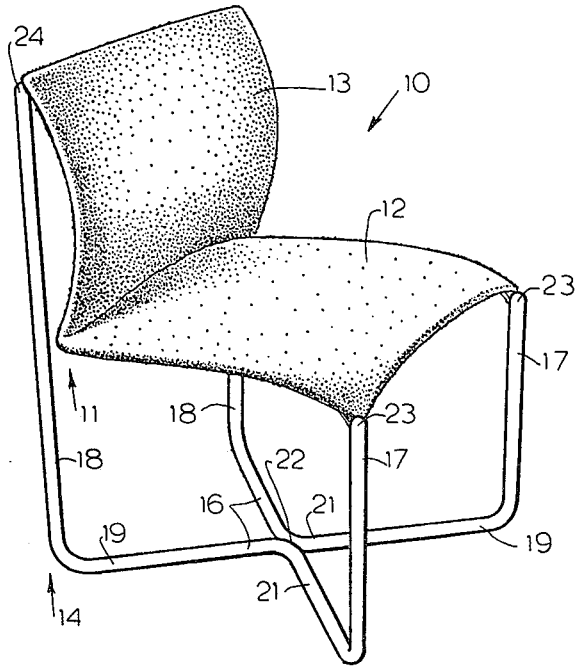
FIG. 1 is a perspective view of an assembled chair embodying the invention.

FIG. 1 illustrates that a chair 10 of the invention includes a seat-back unit 11 comprising a seat portion 12 and a back portion 13, and a chair frame 14. The chair frame 14 preferably comprises a generally X-shaped base part 16 for meeting the floor or support surface, and generally upright front and rear legs 17 and 18, respectively, affixed to and extending upwardly from the extremities of the X-shaped base 16. As indicated, this may be accomplished by use of two preferably tubular members 19 at left and right, each formed into a front leg 17, a generally horizontal bottom support portion 21 forming one half of the X-shaped base 16, and a rear leg 18. The two halves 21 of the base 16 are affixed together, preferably by welding, at a generally central location 22. If the legs or members 19 are tubular as is preferred, they may be of any suitable cross-sectional shape, and the term "tubular" is intended to mean any such shape. The shape illustrated herein is circular.

Figure 2:
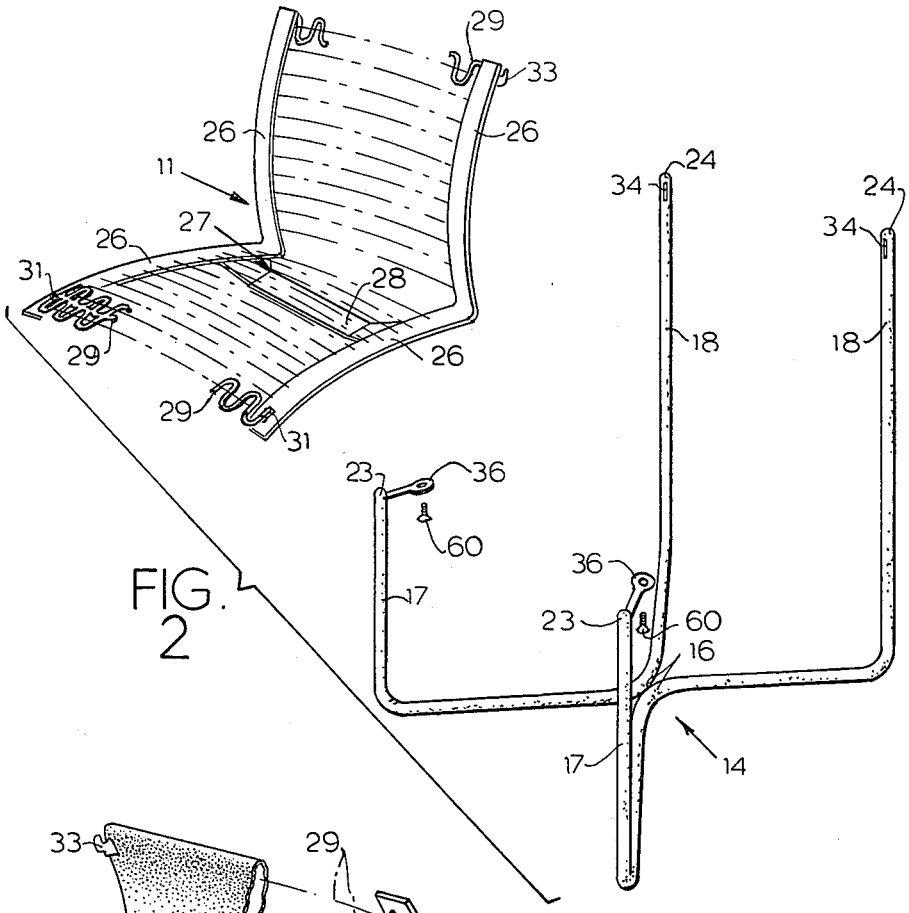
FIG. 2 is an exploded perspective view showing the construction of the chair, with a seat-back unit shown disconnected from a frame.

As illustrated in FIGS. 1 and 2, the seat-back unit 11 is supported at only four support points on the chair frame 14 in a "cradling" arrangement, two support points 23 being located at or near the top of the front leg members 17, and the other two support points 24 being located at or near the tops of the rear leg members 18. FIG. 2 also shows the inner construction of the seat-back unit 11, which comprises a pair of side support members or side frame members 26 of a relatively rigid but flexible material such as flat spring steel, each member 26 being unitary through the back portion 13 and the seat portion 12 and being arched outwardly or upwardly as shown. The term "flat" used in describing the side frame members is intended to means of elongate rectangular cross section, even though the members themselves are not flat. The two side frame members are held apart in spaced, generally parallel relationship by a cross stretcher member 27 which may be of flat spring steel or mild steel. This stretcher member is attached to the undersides of the side frame members 26, by riveting or welding, and it includes an offset or downwardly spaced central porton 28 for accommodating downward flexure of the seat portion 12 without interference.

Between the side support members 26 is stretched a sinuous spring wire material 29 such as that disclosed in U.S. Pat. Nos. 3,843,477 and 3,720,568. As described in the patents, this material is preferably coated with plastic, which may actually serve to link the inner wires together and which also gives certain desired performance characteristics. The sinuous spring wire material for the seat is originally formed in a cylindrical shape, and must be stretched out with approximately 300 to 400 pounds pull for installation on the seat-back unit 11. For the back the material 29 is formed in a flatter shape requiring much less tension. The material 29 is therefore in constant tension, and arches upwardly on the seat portion and rearwardly on the back portion, in a tranverse direction with respect to the arched side support members 26. By this arrangement the material 29 is "prestressed", and this helps provide support for the user.

Figure 3:
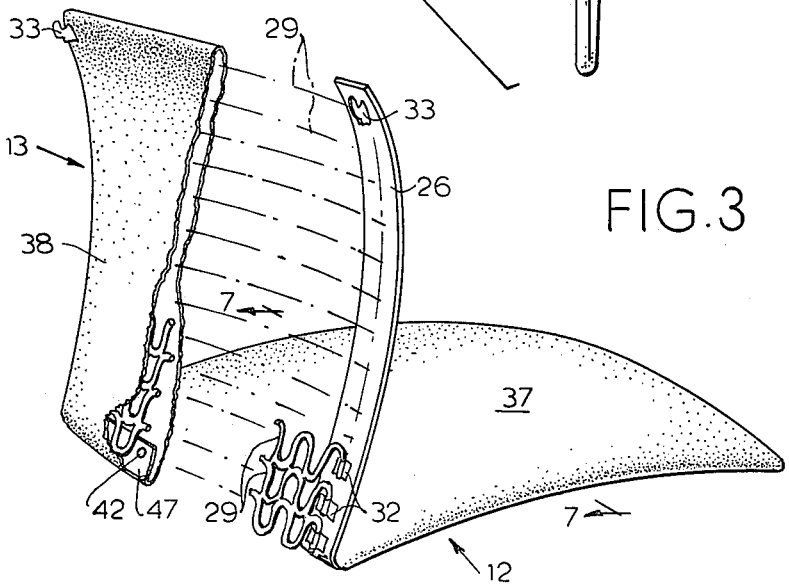
FIG. 3 is a partially broken-away perspective view from a rear side angle of the seat-back unit, showing its internal construction.

The sinuous spring wire material 29 is preferably in two separate panels, one for the back portion 13 and one for the seat portion 12. The material 29 in the seat portion is attached by clips or hooks 31 to the upper side of the side frame members 26. These clips 31 may extend over the edges of the side frame member 26 as shown. In the case of the back portion 13, the sinuous spring wire material 29 is connected to the back sides of the side support member 26, as illustrated in FIG. 3, by clips 32 which are preferably riveted or spot welded to the members 26 and crimped over the sinuous spring wire material. Herein and in the appended claims, the term "sinuous spring wire material" is intended to mean the plastic-coated structure illustrated herein and described in the above-referenced patents, and also variations in configuration of such spring wire material, some of which are disclosed in the patents.

FIG. 2 also illustrates that the preferable means of connection of the seat-back unit 11 to the chair frame 14, at the four support points 23 and 24, comprises a pair of rearwardly extending hooks or hooked flanges 33 at the tops of the side frame members 26 which engage slots 34 formed near the tops of the rear leg member 18, and struts or braces 36 extending back and inwardly from near the tops of the front leg members 17, for attachment to the bottoms of the side frame members 26, near their front ends. The support arrangement will be described in greater detail below.

FIGS. 3, 4, 5, 6 and 7 illustrate various features of construction of the seat-back unit, including outer coverings 37 and 38 applied to the seat portion 12 and to the back portion 13, respectively. Both coverings are in the nature of upholstery, but are removable. They may comprise a woven fabric material, a leather or plastic material, or any other suitable covering material. The term "fabric" as used herein and in the appended claims is intended broadly to mean any type of covering material.

As the figures illustrate, the back portion cover 38 is preferably a sleeve formed to be slipped over the back portion, then snapped together. The seat portion cover 37 preferably extends under the edges of the seat portion only a short distance, and the extending flaps 39 are connected together at the front corners as shown in FIG. 6, preferably by a grommet type fastener 41. The grommet fasteners, which permanently secure the two flaps 39 together at the front corners, still permit the seat portion cover 37 to be removed from the seat portion, since the front corners of the cover 37 can be slipped over the seat portion. Back of the grommets 41 on the side flaps 39 of the seat portion 37 are a series of snap fasteners 42 which may be employed to secure these flaps to the undersides of the side frame memers 26 (receiving snaps on side frame member underside not shown). Alternatively, the arrangement of FIG. 7 may be used, whereby a preformed elastomeric member 43 is secured and partially enveloped within the flap 39, and it may extend up and over the edge of the seat portion as indicated, also functioning to cushion the side edges of the seat portion. The elastomeric strips 43 may be secured to the flap 39 by gluing. When the preformed strips 43 are slipped over the side frame members 26, they engage the side frame members in such a way as to hold the seat portion cover 37 in place. At the front and rear of the seat portion, there is no frame member 26 or other rigid member over which an elastomeric strip 43 could be secured. Therefore, snaps 42 are preferably used on the front and rear flaps 39, even when the elastomeric connection means is used on the sides. The receiving snaps (not shown) may be secured to the underside of the arcuate spring wire material 29 by a suitable attaching arrangement.

FIG. 7 also shows a form of hook or clip 31 which may be used to secure the side edges of the sinuous spring wire material 29 to the side frame members 26.

As FIG. 5 illustrates, the seat portion cover 37 is preferably secured to the back portion cover 38 at two narrow areas 44, generally at the locations where the side frame members extend from the seat portion to the back portion. Between the side frame members the back flap 39 of the seat portion is folded under, as discussed above, and the back portion cover 38 is also secured to itself in this area. The back portion cover 38 is preferably a sleeve, with side flaps 46 turned under and sewn together. Thus, a sleeve is formed with an open bottom, and snaps 42 on a back, downwardly extending flap 47 are secured to receiving snaps 48 on the bottom front fabric of the sleeve 38. This is partially illustrated in FIG. 3, which indicates that the receiving snaps 48 are preferably on the back side of the front fabric panel of the cover 38, so that the back flap 47 is tucked in behind the front panel. In any event, the snaps 42 and 48 securing the bottom of the back portion cover sleeve 38 together are not seen as the chair is normally viewed because of the upward arching of the seat portion 37, as best seen in FIG. 3.

Between the sinuous spring wire material 29 and the covers 37 and 38 are prerferably included a relativey thin layer of padding 49 and an "insulator" layer 51, the function of which is to distribute the force of the sinuous spring wire material 29 so that the wires are not felt by the user. The insulator layer 51 may comprise, for example, a mesh of extruded or woven polypropylene. The padding 49 can be quite thin because the sinuous spring wire material 29 provides for comfort and softness in itself. The padding is preferably secured to the underside of the cover 37 or 38, as illustrated in FIG. 7, without extending into the flaps 39. However, the insulator layer 51 is preferably secured to the upper side of the sinuous spring wire material, by any suitable means. This arrangement of the insulator 51 and the padding 49 is the same at the seat portion 12 and at the back portion 13.

When the covers 37 and 38 are to be installed, they comprise a single unit, with the back cover 38 forming a sleeve open at the bottom. This sleeve is slipped downwardly over the back portion 13. The hooks 33 extending back from the top corners of the back portion are smooth and rounded, so that the sleeve 38 is not snagged or damaged by them. The rearwardly arched sinuous spring wire material of the back can be flexed inwardly somewhat to provide a greater degree of slack in the sleeve 38 for pulling it over the back portion. When the sleeve 38 has been pulled into position, the hooks 33 are guided through holes 52 provided at the appropriate locations in the back side of the sleeve, as illustrated particularly in FIG. 5. The extending flap 39 at the back of the seat portion cover is then hanging downwardly as shown in FIG. 4. The front corners of the seat portion cover 37 may now be pulled over the corners of the seat portion as discussed earlier, and snaps may be secured on the four flaps of the seat portion cover and on the depending flap 47 of the back sleeve 38 as described above. If the elastomeric border material 43 is used on the sides, it may be slipped into place at this point.

FIGS. 8, 9 and 10 illustrate the assembly of the seat-back unit 11 to the chair frame 14, and particularly to the rear leg members 18, which is accomplished after the seat-back unit has been completely assembled, with the covers 37 and 38 fully installed. The rearwardly extending hook 33 at each side of the back portion 13 is shaped substantially as shown in FIGS. 8–10, with an arcuate cutout area 55, a rounded blade or flange 56 and a stop abutment 57. The hook 33 is relatively smooth and with rounded edges, as discussed above, to avoid tearing of the back cover upon installation.

The hooks 33 are first inserted into the vertical slots 34 with the back portion 13 of the seat-back unit in a generally horizontal position, as illustrated in FIG. 9. The slots 34 are narrow to prevent side-to-side movement and to adequately transfer forces on the seat-back unit into the leg system. The seat-back unit is then pivoted downwardly and rearwardly, as shown in FIGS. 9 and 10, until the stop abutment 57 engages against the face of the tubular rear leg 18, as shown in FIG. 10. At this point the arcuate recess 55 is engaged by the leg structure at the top of the slot 34, and the abutment of the blade portion 56 against the inner surface of the leg 18 prevents further rotation of the hook 33 and of the top portion of the seat back 13. However, at this point the front of the seat portion 12 is still several inches above the struts or braces 36 which are affixed to the front legs 17 as shown in FIG. 2. To complete the assembly, the front end of the seat portion 12, i.e. the front ends of the side frame members 26, are forced downwardly further until they reach the struts 36, moving the seat back into approximately the position shown in dashed lines in FIG. 10. This tightens the engagement of the stop 57 and causes both legs of each side frame member 26 to bow outwardly slightly further, putting them in a "prestressed" condition which aids in the support function, including the versatile lower back support feature described below, and which also has the advantage of constantly maintaining pressure between the stop 57 and the tubular leg 18, preventing these connections from rattling. Cooperation between the frame 14 and the seat-back unit 11 also enables the chair 10 to adjust to an uneven floor surface.

Once the seat-back unit has been forced into the assembly position, with the front of the seat portion positioned adjacent to the supporting struts 36, connection is made as illustrated in FIG. 11. Each of the struts 36 includes a flattened outer end 58 having an "eye" opening 59 through which a fastener such as a bolt 60 may be passed, to connect with a nut 61 which is recessed into the side frame member 26 as shown, preferably in a non-circular hole so that rotation of the nut is prevented. As indicated, the upper portion 62 of the nut, which lies on top of the side frame member 26, preferably does not extend higher than the sinuous spring wire material 29, so that the nuts are not felt by the user of the chair. The bolt and nut connection means illustrated as merely an example, and any convenient, removable form of fastener may be used.

FIG. 11 also indicates the manner in which the brace or strut is connected to the front leg member 17. This is efficiently accomplished by provision of an opening 63 in the backside of the tubular leg member 17, with the shaft 64 of the strut inserted through the opening and the end of the strut welded to the inside surface of the leg 17.

FIG. 12 shows a completed front corner assembly, in a bottom plan view with the leg 17 seen in section. The bolt 60 connecting the strut 36 to the side frame member 26 passes through two layers of covering fabric 37, being positioned to pass through the grommet 41 (see FIGS. 11 and 6) which connects the two adjacent seat-cover flaps 39. Also visible in FIG. 12 are the sinuous spring wire material 29 immediately above, and the insulator mesh 51 above the material 29.

Figure 13:
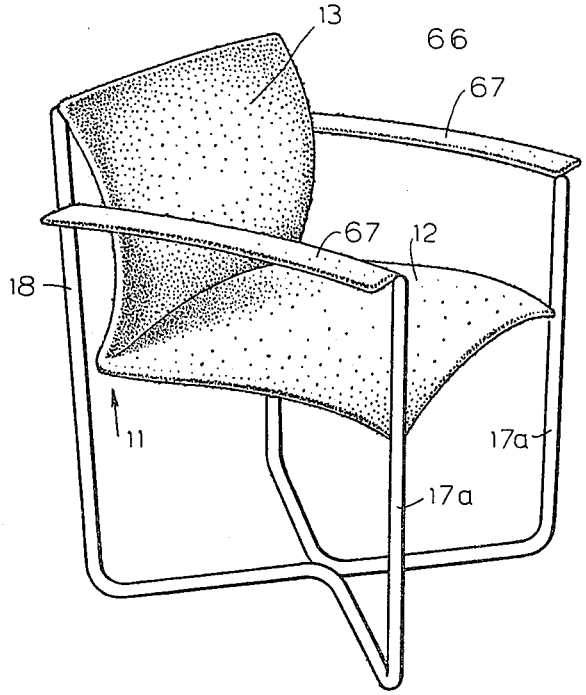
FIG. 13 is a perspective view showing another embodiment of a chair according to the invention, similar to the first embodiment but including arms.

FIG. 13 shows an armchair 66 according to the invention. Similar to the first-described chair in other respects, the armchair 66 has longer front leg members **17*a*, extending above the seat portion 12 of the seat-back unit 11 to support a pair of armrests or arms 67. The arms 67 are preferably secured to the front legs 17*a* and the rear legs 18 of the chair frame similarly to the manner in which the front of the seat portion is connected to the legs 17 in the chair 10 described above. The same type struts 36 (not shown in FIG. 13) are used, as seen in FIGS. 2 and 11, but are oriented in outwardly angled directions to receive the ends of the armrests 67. The "cradling" suspension system for the seat-back unit 11 is identical to that of the chair 10 described above, and the discussion below relating to the function of the suspension system applies to both types of chair. The armrests 67** may be covered by fabric similar to that of the seat-back unit, and such covering may be removable.

FIGS. 14 through 17 demonstrate the automatically adjustable support the chair 10 (or 66) of the invention provides for users of different height and weight. Unique comfort for the user is afforded by a combination of features and occurrences. The sinuous spring wire material incorporated in the seat-back unit 11 provides a tailor-shaped conformability in the seat and back areas. However, the material can do so only within limits. The frame of the seat-back unit also has unique tailor-shaping characteristics, supplementing the effect of the sinuous wire material.

In the schematic representations of FIGS. 14 through 17, the illustrated outline of the seat-back unit 11 is representative of the various positions and configurations of the side rail members 26 shown and described above. These members, which are of a relatively rigid but elastic material such as spring steel, play a very important role in providing the high degree of comfort of the chair 10. The side frame members bend into varying radii to help the assembly to custom fit the sitter. The unique "cradling" support arrangement for the seat-back unit on the frame, wherein the seat-back unit hangs from the tops of the four legs, provides an automatic variability in radius of the side frame members in the back portion 13.

Figure 14:
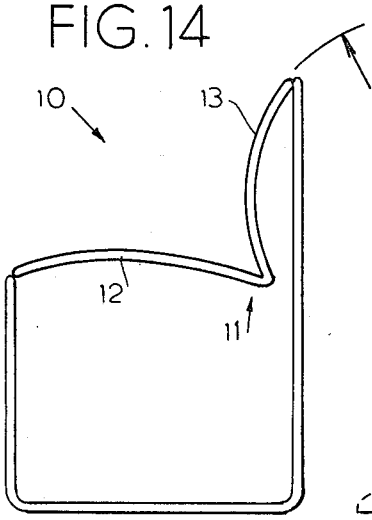
FIGS. 14 through 17 are schematic side views of the chair of the invention, illustrating a principle of the invention by which lower back support is provided for a range of users' sizes and heights.

In FIG. 14, $R_1$ is the smallest back portion radius, when no one is sitting in the chair. Both the seat portion 12 and the back portion 13 follow approximately arcuate curves.

Figure 16:
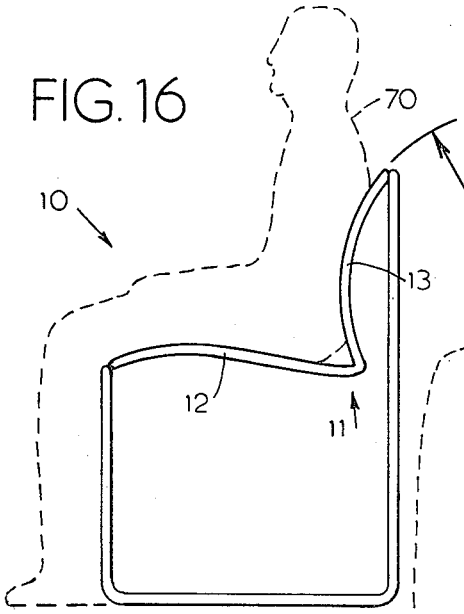

FIG. 16 shows the chair 10 with a smaller-than-average person 70 seated, a person of light weight. $R_3$ is only a small amount larger than $R_1$ in this case. This matches the curvature of the lower back, since the relatively small sitter 70 has a small-radius lumbar curvature. The back portion 13 fits suitably because the sitter does not stretch and flatten the curvature of the back portion 13 to a great degree, leaving $R_3$ relatively small.

Figure 15:
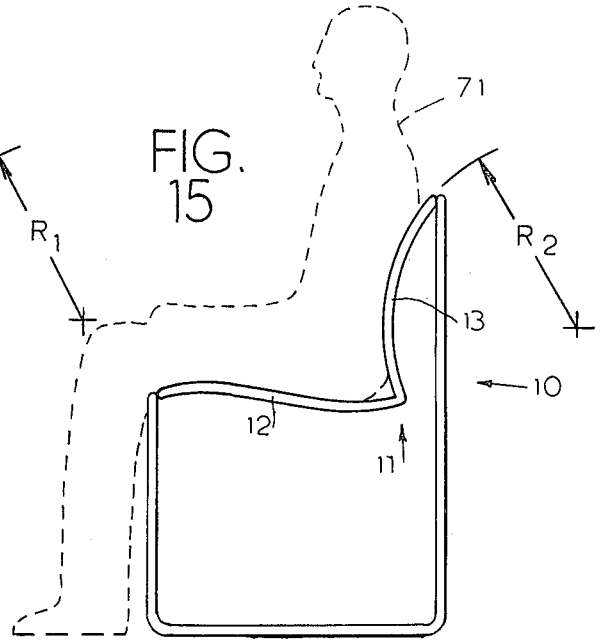

In FIG. 15, an average-sized person 71 sits in the chair 10, and $R_2$ is larger than $R_3$, giving the sitter 71 a somewhat flatter back support curve. This is appropriate because the larger person 71 has a larger lumbar radius of curvature. Again, a great degree of comfort results, through proper back support.

Figure 17:
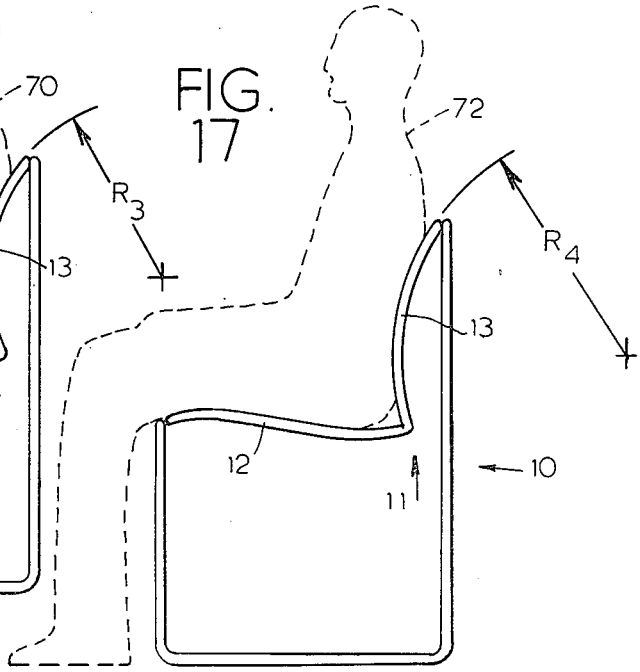

FIG. 17 shows a large and tall person 72 sitting in the chair 10, causing the back portion 13 of the chair to stretch and flatten still further. $R_4$ is thus larger than $R_2$ and considerably larger than $R_1$, and the tall person's large radius of lumbar curvature is correctly accommodated.

Small obese persons will also stretch and flatten the back to a relatively large radius, forming an appropriate radius of curvature for back support, since an obese person generally has a larger lumbar radius of curvature than an average weight person of similar height.

Tall but thinner-than-average persons will similarly be accommodated in their lower backs, which generally have a relatively small radius of lumbar curvature for a person of that height. The back portion 13 of the chair does not enlarge its radius very much, because of the lesser bearing weight of the tall but thin person.

It should be understood that a true circular arc will not always be defined by the back portion 13 of the chair. However, the shape of the back portion in its varying degrees of deformation is approximately arcuate, and the discussion above involving radii of curvature is intended to approximate what actually occurs.

Back comfort for the sitter is of the utmost importance, especially in chairs occupied by sitters for long periods of time. The comfort provided by the automatic adjusting features of the present chair construction is a novel and salient feature of the invention.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

I claim:

1. A chair comprising:

a pair of elastically deformable, generally L-shaped side frame members, forming a seat portion with a forward edge and a back portion with an upper edge, the side frame members being arched forwardly in the back portion and arched upwardly in the seat portion;

stretcher means spaced well away from the forward and upper edges, holding the side frame members apart, in generally parallel relationship, and being the only structure holding the side frame members apart;

flexible user support means extending between the side frame members in the seat portion and the back portion;

a chair frame adapted to be supported on a surafce, the frame having a pair of spaced upper rear support points and a pair of spaced front support points;

first connecting means connecting the upper ends of the side frame members, in the back portion, to the upper rear support points; and second connecting means connecting the front ends of the side frame members, in the seat portion, to the front support points;

whereby the seat portion and back portion are supported as a flexible unit in cradling fashion from the four support points, and the side frame members in the seat portion flatten to varying degrees depending on the weight of the user, resulting in correct support for most users and a high degree of comfort.

2. The chair of claim 1, wherein the chair frame comprises a pair of tubular members, each being formed into a generally vertical front leg having one of the front support points near its top, a generally horizontal surface-engaging bottom portion extending from the bottom of the front leg inwardly to a generally central location and outwardly to the rear, and a generally vertical rear leg extending up from the back of the generally horizontal portion and having one of the upper back support points near its top, the bottom portions of the tubular members being connected together at said generally central locations.

3. The chair of claim 1, wherein the chair frame comprises tubular members and the first and second connecting means enable ready detachment of the side frame members from said chair frame, and said first connecting means comprises a generally vertical slot in the tubular member at each of the upper back support points and a hooked flange extending back from the upper end of each side frame member, engaged in the corresponding slot.

4. The chair of claim 3, wherein the hooked flanges curve upwardly, with an upwardly oriented hook portion at the top, each including a forward-facing upper edge for engaging against the inside surface of the tubular frame member when inserted, and a stop abutment at its lower edge for engaging against the outside surface of the tubular member just below the slot when the hooked flange has been inserted in the slot, thereby preventing further downward rotation of the hooked flange and the top of the side frame member, with the hooked flanges so oriented on the seat-back unit that the front ends of the side frame members must be forced downwardly to reach the front support points of the frame, flexing and prestressing the side frame members when the front ends of the side frame members are connected to the front support points.

5. The chair of claim 1, wherein the chair frame comprises tubular members including a pair of generally upright front leg members, a pair of generally upright rear leg members, longer than the front leg members, and a generally X-shaped base adapted to rest on a surface, the four extremities of the X-shaped base leading to the bottom ends of the four upright leg members.

6. The chair of claim 1, wherein the flexible user support means comprises two series of sinuous spring wires extending laterally across the side frame members, touching each other at a series of points and each united by an integral plastic coating surrounding the wires to provide a back assembly and a seat assembly, the ends of the wires in each assembly being secured to the side frame members.

7. The chair of claim 6, wherein the sinuous spring wire material is prestressed and arched upwardly in the seat portion and rearwardly in the back portion.

8. The chair of any of claims 1 to 7, wherein said stretcher means consists of a single rigid spacer bar bridging between the undersides of the L-shaped side frame members in the seat portion adjacent to and forward of the back portion, said spacer being the only rigid member bridging the side frame members.

9. A chair construction, comprising:

a unitary seat-back combination unit for supporting a sitter, said unit being somewhat elastically flexible;

a chair frame of tubular members, adapted to be supported on a surface and having a pair of spaced upper rear support points and a pair of spaced front support points;

a generally vertical slot in the frame at each of the upper rear support points and a hooked flange extending back from the upper end of the seat-back unit at each side of the unit, engaged in the corresponding slots, the hooked flanges curving upwardly and each including a stop abutment at its lower side for engaging against the tubular member just below the slot when the hooked flange has been inserted in the slot, thereby preventing further downward rotation of the hooked flange and the top of the seat-back unit, with the hooked flanges so oriented on the seat-back unit that the front end of the seat-back unit must be forced downwardly to reach the front support points of the frame; and means detachably connecting the front end of the seat-back unit to the front support points in said downwardly forced configuration;

whereby the seat-back unit is flexed and prestressed when the front end of the seat-back unit is connected to the front support points, producing a tight, rattle-free assembly.

10. A chair, including in combination:

a relatively rigid frame made of two members secured together at a single point, each said frame member comprising a single continuous member providing two of four legs joined by a base, the base having portions extending from each leg into the center, said two frame members being secured together solely at said center, the rear legs extending much higher than the front legs, and a unitary seat-back assembly providing both a seat and a back and attached directly to said frame at only four points, one on each leg, the seat having two front corners each attached to an upper portion of a front leg and the back having two upper corners each attached to an upper portion of a rear leg.

11. The chair of claim 10 wherein one frame member forms the left legs and the other forms the right legs, each frame member having a V-shaped base extending from the front and rear legs into a central vertex, with the two frame members secured together solely at the vertex.

12. A chair comprising:

a seat-back unit including:

a parallel pair of relatively rigid but springingly flexible side frame members of generally L-shape, each with a generally horizontal base portion arched upwardly and a generally vertical upright portion arched forwardly, the upright and base portions meeting at a cusped corner;

a single rigid spacer bridging between the undersides of the base portions adjacent to and forward of said corners, said spacer being the only rigid member bridging said unit; and springable user support means extending laterally across said side frame members, to provide a back assembly bridging said upright portions and a seat assembly bridging said base portions, the left and right ends of the user support means in each assembly being secured to the side frame members; and a frame including four legs, the legs being secured to the L-shaped side frame members only at the top of the back assembly and the front of the seat assembly.

13. The chair of claim 12, wherein the springable user support means comprises two series of sinuous spring wires extending laterally across the side frame members, touching each other at a series of points and each united by an integral plastic coating surrounding the wires to provide a back assembly bridging said upright portions and a seat assembly bridging said base portions, the ends of the wires in each assembly being secured to the side frame members.

14. The chair of claim 12, wherein the L-shaped side frame members are flat and wider than high.

15. A chair, comprising:

a chair frame adapted to be supported on a surface and including a pair of spaced upper rear support points and a pair of spaced front support points, with means providing for shifting flexibility of the spacing between the support points with the weight of a sitter in the chair, a seat-back unit supported on the frame, the seat-back unit having two relatively rigid frame pieces, one at the left edge and one at the right edge, the frame pieces being elastically deformable under the weight of a sitter in the chair, stretcher means extending between the two frame pieces, spaced well away from the upper edge and the forward edge of the seat-back unit, for holding the frame pieces in spaced relationship, being the only structure holding the frame pieces apart so that the frame pieces are relatively shiftable and flexible with respect to one another, first connecting means connecting the upper ends of the frame pieces to the upper rear support points, second connecting means connecting the front ends of the frame pieces to the front support points, so that the seat-back unit is connected to the chair frame at only four support points, and support means comprising two series of sinuous spring wires attached to and extending laterally between the frame pieces, touching each other at series of points and each united by an integral plastic coating surrounding the wires to provide a back assembly and a seat assembly, the sinuous spring wires being arched upwardly in the seat assembly, the spring wires and the arching being cooperative with the flexibility of the frame pieces and the relative flexibility and shiftability between them to provide a high degree of accommodation and comfort for different users.

* * * * *